US005673075A

United States Patent [19]

Jacobs et al.

[11] Patent Number: 5,673,075

[45] Date of Patent: Sep. 30, 1997

[54] CONTROL OF TONER DEPOSITION IN GRAY PIXEL HALFTONE SYSTEMS AND COLOR PRINTING

[75] Inventors: Timothy W. Jacobs, Fairport; Jeffrey D. Kingsley, Williamson, both of N.Y.

[73] Assignee: Xerox Corporation, Stamford, Conn.

[21] Appl. No.: 508,504

[22] Filed: Jul. 28, 1995

Related U.S. Application Data

[63] Continuation-in-part of Ser. No. 84,094, Jul. 1, 1993, abandoned.

[51] Int. Cl.[6] ..... B41J 2/47

[52] U.S. Cl. ..... 347/131; 358/298; 358/251

[58] Field of Search ..... 347/131, 251, 347/252, 240; 399/180, 181, 258, 259; 358/298

[56] References Cited

U.S. PATENT DOCUMENTS

| | | | |
|---|---|---|---|
| 3,718,397 | 2/1973 | Smajo . | |
| 3,799,668 | 3/1974 | McVeigh . | |
| 4,751,377 | 6/1988 | Ishizaka et al. . | |
| 4,814,893 | 3/1989 | Katoh . | |
| 4,868,587 | 9/1989 | Loce et al. . | |
| 4,963,990 | 10/1990 | Henderson et al. . | |
| 4,989,039 | 1/1991 | Hayashi et al. . | |
| 5,072,291 | 12/1991 | Sekizawa . | |
| 5,153,609 | 10/1992 | Ando et al. . | |
| 5,198,898 | 3/1993 | Miyata . | |
| 5,214,446 | 5/1993 | Mitsuda . | |
| 5,266,997 | 11/1993 | Nakane et al. . | |
| 5,276,459 | 1/1994 | Danzuka et al. . | |
| 5,276,531 | 1/1994 | Chen et al. | 358/443 |
| 5,285,220 | 2/1994 | Suzuki et al. . | |
| 5,309,177 | 5/1994 | Shoji et al. . | |
| 5,313,308 | 5/1994 | Hasegawa et al. . | |
| 5,315,352 | 5/1994 | Nakune et al. . | |
| 5,319,433 | 6/1994 | Fukushima et al. . | |
| 5,323,247 | 6/1994 | Parker et al. . | |
| 5,343,282 | 8/1994 | Kazuki et al. . | |
| 5,343,309 | 8/1994 | Roetling . | |
| 5,345,315 | 9/1994 | Shalit . | |
| 5,351,107 | 9/1994 | Nakune et al. . | |
| 5,353,052 | 10/1994 | Suzuki et al. . | |
| 5,365,313 | 11/1994 | Nagamochi et al. . | |
| 5,387,985 | 2/1995 | Loce et al. | 358/447 |
| 5,479,263 | 12/1995 | Jacobs et al. | 358/298 |

*Primary Examiner*—Mark J. Reinhart
*Attorney, Agent, or Firm*—Oliff & Berridge

[57] ABSTRACT

In a printer, a controller keeps track of the imager's operation. The original image is transferred into a continuous tone image by using a tone reproduction curve. That signal is encoded into gray pixel data by a halftoner. The pixel data contains the pixel location and the desired darkness of gray, i.e., amount of toner deposited. An imager uses the pixel data to generate the final halftoned image in a printer. A controller generates a feedback signal based on the printer's operation and the quality of the final halftoned image. The imager uses the feedback signal to modify the encoded gray pixel data in order to adjust the final halftoned image. The original coding of the image into gray pixel data is generic and does not depend on the characteristics of the printer being used. This invention reduces the computation of gray pixel data and allows the imager to be separate from the apparatus generating the gray pixel data.

18 Claims, 3 Drawing Sheets

CONTROL OF TONER DEPOSITION IN GRAY PIXEL HALFTONE SYSTEMS AND COLOR PRINTING

CROSS REFERENCE TO RELATED APPLICATIONS

This application is a continuation-in-part application based in part on application Ser. No. 08/084,094, filed Jul. 1, 1993, now abandoned. This application is also related to U.S. patent application Ser. No. 08/084,096, filed Jul. 1, 1993, now abandoned, owned by the assignee of the present invention, the disclosure of which is incorporated by reference herein.

BACKGROUND OF THE INVENTION

1. Field of the Invention

This invention relates to improvements in control of toner deposition in a gray halftone system. More particularly, this invention uses a control system to control toner area coverage on copy sheets based on encoded gray pixel halftones and characteristics of the printer by using image output terminal feedback.

2. Description of the Related Art

In color printing, the control of toner area coverage is important. If the area coverage is not controlled, the colors will vary causing a poor color fidelity. In the prior art, a controller monitors the area coverage and provides feedback to alter the input byte map via a toner reproduction curve. Therefore, the halftone process is repeated before the imaging can occur. To adjust the copy quality, an 8-bit contone (continuous tone) image and thus the halftoner output were modified before sending the information to the imager.

The method of the prior art is laborious and inefficient. Furthermore, the method limits the uses of the halftoner and imager because these units must be linked together. In these systems, even if the problem exists only in the imager, the halftone process must be repeated.

SUMMARY OF THE INVENTION

In the invention, the controller keeps track of the printer's operation. The toner area coverage on a copy sheet is monitored and altered based on both the pixel data from the halftoner and the image output terminal (printer) feedback system.

The pixel data is based on a new method of encoding halftones images, using gray pixels and pixel codes, as disclosed in related U.S. patent application Ser. No. 08/084,096, filed Jul. 1, 1993, now U.S. Pat. No. 5,479,263; owned by the assignee of the present invention, the disclosure of which is incorporated by reference herein. The encoded pixel data contains the structure and the desired darkness of the gray pixel, i.e., the amount and location of the toner deposited within the pixel.

The feedback from the controller, which monitors the operation of the printer, is used to regulate the darkness of the pixels by the amount of light to which the photoreceptor is exposed. The light exposure is directly related to toner development. For example, the halftoner outputs a signal requiring a 50% gray for a specific pixel. The imager produces the desired grayness based on the characteristics of the printer at that time. This is accomplished by adjusting the width of each pixel's light pulse based on a look-up table (LUT) which translates pixel codes into ROS light modulator pulsing characteristics. The controller feedback only modifies the pulse width information in the LUT, typically fewer than 32 unique values.

Therefore, the modification by the controller feedback of the 8-bit data input (contone image) to the halftoner is not necessary in the invention.

BRIEF DESCRIPTION OF THE DRAWINGS

The invention is illustrated in the accompanying drawings, in which like reference numerals are used to denote like or similar parts, and wherein.

DETAILED DESCRIPTION OF THE PREFERRED EMBODIMENTS

While this invention is described in some detail herein, with specific reference to an illustrated embodiment, it is to be understood that there is no intent to be limited to that embodiment. On the contrary, the aim is to cover all modifications, alternatives and equivalents falling within the spirit and scope of the invention as defined by the claims. For example, the invention is not limited to printing devices. An image rendering device that performs halftoning may employ the described controlling method, such as, for example, a CRT display device. Although this invention uses a laser imaging system commonly called a raster output scanner (ROS), an LED system and the like can also be used.

Figure 1:
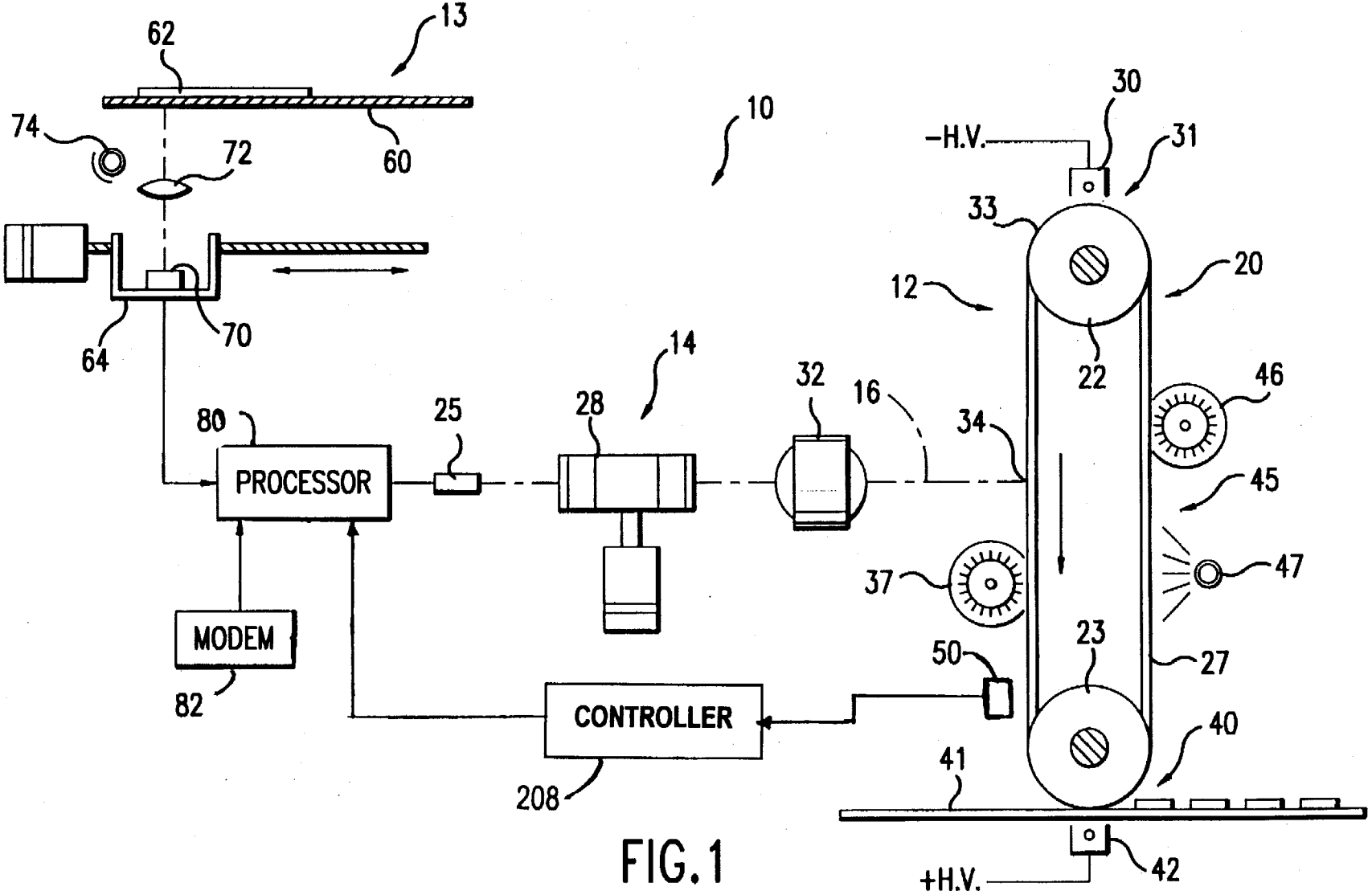
FIG. 1 is a block diagram of a printer.

FIG. 1 shows an exemplary electronic printer 10. Printer 10 includes a xerographic processing section 12, a document scanning section 13, and an image printing section 14.

Xerographic processing section 12 has a photoreceptor 20 in the form of an endless belt stretched across drive belt support roller 22 and idler belt support roller 23. Latent electrostatic images representative of the image signal input are created on the photoreceptor 20. Belt supporting rollers 22,23 are rotatably mounted in predetermined fixed position by suitable means (not shown). Roller 23 is driven from a suitable drive motor (not shown) to move photoreceptor 20 in the direction shown by the solid line arrow. The photoreceptor 20 could also be a photoreceptor drum or another equivalent device.

A corona charging device 30, which is commonly known as a corotron, is operatively disposed adjacent the photoreceptor 20 at charging station 31. Corotron 30, which is coupled to a suitable negative high voltage source (−H.V.), places a uniform negative charge on the photoreceptor 20 in preparation for imaging.

The image printing section 14 includes a variable pulse width imaging beam of light 16 for scanning across photoreceptor 20 at exposure point 34. Imaging beam 16 is derived from an individual self modulated I.R. diode laser 25. Beam 16 is swept across photoreceptor 20 by a rotating polygon 28. A suitable lens 32 focuses the imaging beam 16 onto the photoreceptor 20. The charges on the photoreceptor are selectively dissipated as the imaging beam 16 sweeps across the photoreceptor 20. The latent electrostatic image formed on photoreceptor 20 corresponds to the original document.

A development subsystem 37, which is illustrated as a magnetic brush roll, is disposed in operative contact with the photoreceptor 20 downstream of the exposure point 34. The toner, which is a relatively small colorant material, is loaded onto the development subsystem's magnetic brush roll. Due to electrostatic forces on the charged photoreceptor, the toner is attached to the charges forming the latent electrostatic image.

Following development of the latent electrostatic image on the photoreceptor 20 by developing subsystem 37, the developed image is sensed by toner development sensor 50. One type of toner development sensor well known in the art measures electrostatic fields or potentials and so is responsive to the amount of charged toner developed on the photoreceptor's electrostatic latent image. Toner development sensor 50 provides a feedback signal which is processed by the controller 208. The sensor is positioned to measure within a particular band on the photoreceptor. To properly perform the feedback signal calculation the controller monitors the sensor 50 output at times when an image of known darkness value and area is being sensed. This could either be a special test image which is generated on the photoreceptor between or beside "user" document images or a portion of a user document image which happens to have an appropriate image area which passes under the potential sensor 50. Sensor 50 could also be an optical sensor responsive to the reflectivity of the toner developed on the reflective photoreceptor surface and thereby provide an acceptable signal for the feedback calculation. Such optical toner sensors are also well known in the art, an example of which is disclosed in U.S. Pat. No. 5,315,352 to Nakane et al.

The developed image is then transferred to a suitable copy sheet 41 (i.e., paper) at transfer station 40. To facilitate transfer, a transfer corotron 42, which is coupled to a high voltage power source (+H.V.), attaches the developed image on the photoreceptor 20 to the copy sheet 41. Following transfer, the developed image is fixed by fusing. Any residual charges and/or developing material left on photoreceptor 30 are removed at cleaning station 45 by erase lamp 47 and cleaning brush 46.

At document scanning section 13, image data in the form of electrical signals representative of the document reflectance are generated. An original document 62 to be copied is placed on a transparent platen 60. The positioning of the document is performed either manually or by an automatic document handler (not shown). A suitable carriage 64, supported for reciprocating back and forth movement below platen 60, has mounted at least one linear scanning array 70. Array 70 may be any suitable scanning array type as, for example, a CCD. Carriage 64 is driven by a suitable reversible driver such as a step motor (not shown). The lens 72 focuses array 70 on a line of the original document 62. A suitable lamp 74 illuminates the document line being scanned by array 70. The output signal from the array 70 is sent to the processor 80. In the alternative, a modem 82 can be used to receive signals from another source, i.e., a computer, and thereby bypass the document scanning section 13.

Figure 2:
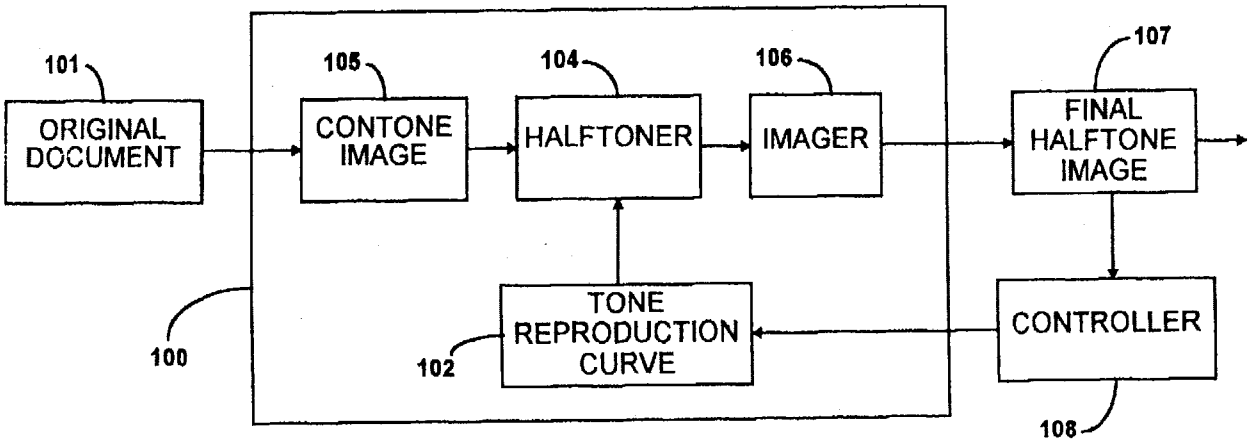
Figure 2 (Prior Art)
FIG. 2 is a control system of the prior art for a typical feedback control system.

Referring to FIG. 2, the basic operation of a processor 100 of the prior art is shown. A tone reproduction curve (TRC) look-up table (102) is used by the halftoner (104) to modify a continuous tone original image to adjust for printer characteristics. The halftoner 104 generates pixel information about which pixels are shaded (black or different levels of gray) based on the output of the toner reproduction curve 102. The imager 106 uses the pixel information to produce the desired image. The controller 108 verifies that shifting of the different colors is not occurring and that the toner area coverage is proper. The toner area coverage sensor 50 in FIG. 1 provides the controller 108 with a measurement of actual toner development for a special test image. Such test image approaches are known in the art, for example, as disclosed in U.S. Pat. No. 5,309,177 to Shoji et al.

When a shift in the color or the toner area coverage is improper in prior processors, the controller 108 outputs a signal to the toner reproduction curve 102. The entire process of using the toner reproduction curve 102, the halftoner 104, and formatting in the imager 106 must be repeated. Therefore, if the shift is caused by an imager problem or by the specific characteristics of the printer, the entire halftone generation process needs to be performed.

Figure 3:
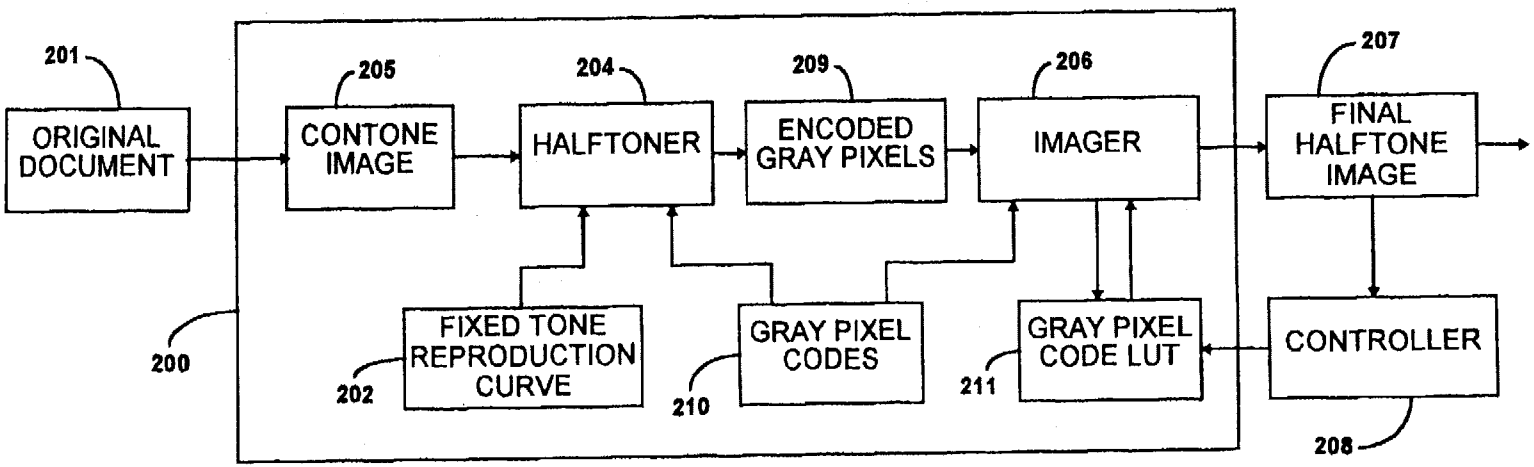
FIG. 3 is a feedback control system of the invention.

FIG. 3 shows a block diagram of a processor 200 generating a halftoned image of the preferred embodiment. The original document image 201 is encoded by the gray pixel halftone encoding method disclosed in our related U.S. patent application Ser. No. 08/084,096, filed Jul. 1, 1993, owned by the assignee of the present invention, the disclosure of which is incorporated by reference herein. The processor 200 creates a contone image 205 from the scanned data of the original document 201. A fixed tone reproduction curve 202 representative of the output devices to which the final halftone image will be sent is stored in the processor. The contone image 205 and the fixed tone reproduction curve 202 are inputs to the halftoner 204. Gray pixel codes 210 are predetermined codings of pixels into certain specific states. In the preferred embodiment the encoding scheme allows a single variable light pulse width to be placed anywhere within a pixel boundary. The width of the light pulse will control the amount of toner developed by that pixel, hence the darkness of the pixel. The placement of the pulse within the pixel boundary will help convey spatial information of the original document 201 as well as help the construction of a high quality halftone rendition of the original image.

The gray pixel codes 210 stored in processor 200 are chosen with a recognition of the capabilities of the output printing system to produce distinguishable darkness levels, the desired halftone design characteristics, and, also, the amount of data which will be necessary to transmit and store the encoded halftone image. For example, in a case where a pixel may have four different values of overall darkness and the location of the dark area (the toner coverage area within the pixel boundary) may be at the right edge, left edge or center of the pixel, there are eleven unique states of the gray pixel and the pixel codes 210 would designate these eleven specific gray pixel configurations. Many choices of gray pixel code schemes are possible as is disclosed in related U.S. patent application Ser. No. 08/084,096, filed Jul. 1, 1993. The gray pixel codes 210 stored in processor 200 are also inputs to the halftoner 204.

The halftoner 204 generates encoded gray pixels 209 from the three signal inputs: the contone image 205, the fixed tone reproduction curve 202, and the gray pixel codes 210. The encoded gray pixels 209 are a first halftone image of the original document. The use of gray pixel codes 210, however, allows this encoded halftone image to be transmitted to the imager with far less data than is the case with the prior art system shown in FIG. 2. In the example of a case with eleven unique gray pixel configurations, each encoded halftone image pixel would require only 4 bits of data instead of the 8 bits of data common with prior art halftone systems. In this preferred embodiment, the information encoded by the halftoner, i.e., the pixel data 209, is only the pixel's overall darkness and the location of toner development within the pixel; but other information may be encoded by the halftoner, such as color separation.

The encoded gray pixels 209 are delivered to the imager 206 to be used immediately. In the alternative, the encoded gray pixels 209 can be stored for later use. Furthermore, as shown in FIG. 3, the encoded gray pixels 209 can be decoded by the imager 206 in an optimal fashion depending on the type of printer attached. Specific printer information is provided in the processor 200 by a gray pixel code look-up table (LUT) 211 accessible by the imager. The gray pixel codes 210 stored in processor 200 are input to the imager so that the imager can properly decode the encoded gray pixel image 209 transmitted by the halftone 204. The gray pixel code look-up table (LUT) 211 provides the imager with specific instructions as to how to render each of the gray pixel codes 210. The use of look-up tables to instruct an imager in this fashion is known in the art. For example, a suitable look-up table method for a gray pixel writing systems disclosed in U.S. Pat. No. 5,184,226 to Ciancosi.

The encoded gray pixel data 209 (the first halftone image), the gray pixel codes 210, and the gray pixel LUT 211 are used by the imager 206 to print a final halftone image 207. The imager 206 also receives feedback information from the printing process controller 208. This feedback information maintains the desired gray pixel darkness specified by the gray pixel codes 210 and used by the halftone 204 when rendering the first halftone image, the encoded gray pixels 209. The printing system feedback information conveyed by the controller 208 is received in the form of updates to the gray pixel code LUT 211 in the processor 200. That is, the printing process controller 208 will alter values in the gray pixel code LUT 211 based on the toner area coverage measurement information the controller 208 receives from sensor 50 in FIG. 1 at times when an appropriate test image or original image halftone patch is being sensed by sensor 50 in FIG. 1. The gray pixel code LUT 211 data contains sub-pixel pulse width information and position information for each gray pixel code value. The pulse width is the amount of shading or darkness of the gray pixel. The pulse width value entered in the gray pixel code LUT will be increased, decreased or left unchanged based on the toner area coverage being sensed by sensor 50 in FIG. 1 and calculated by printer controller 208. For example, the pulse width may require 30% shading of the pixel; but the printer is applying too much toner. The controller would alter the gray pixel code LUT 211 so that a pulse width of 25% is actually used in the printer. In other words, a shift in the color of the toner area coverage caused by an imager problem or by the specific characteristics of the printer is adjusted at the imager 206 and not by the toner reproduction curve 202.

Figure 4:
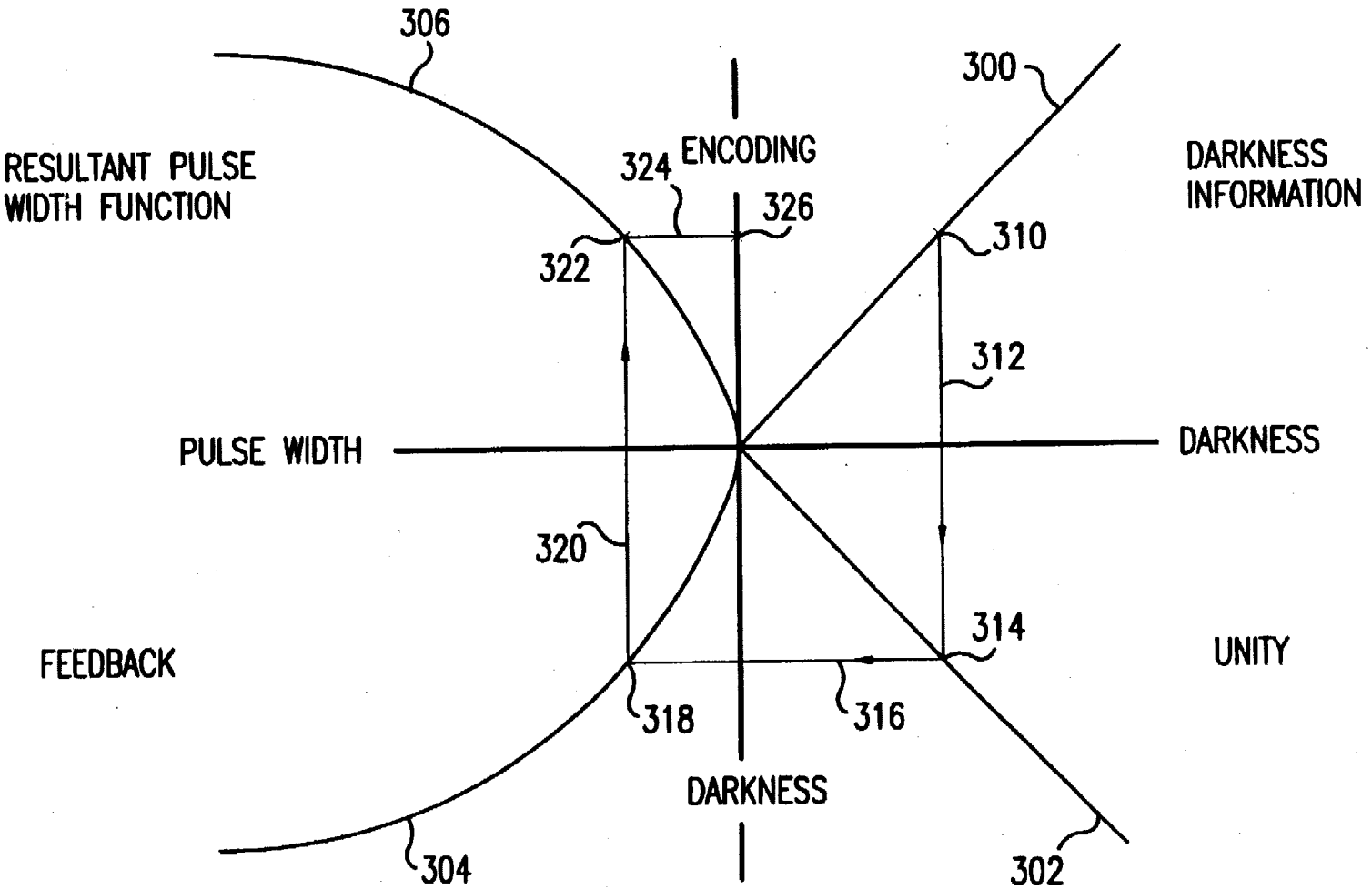
FIG. 4 is a Jones plot used for the invention.

FIG. 4 shows a Jones plot of the feedback process of the preferred embodiment. This Jones plot is used for selecting the necessary pulse width to maintain the proper darkness. Each width specified in the encoding, is assigned a darkness. In this example, the top right quadrant shows a linear relationship 300 between encoding verses darkness. Moving to the right from the abscissa, the darkness of the pixel shading increases. The right-lower quadrant is a unity function which is used as a place holder in the Jones plot. The curve 304 in the lower-left quadrant represents the feedback used in the preferred embodiment. Feedback curve 304 is calculated by the printer controller 208 in FIG. 3 based on the toner area measurement data provided by sensor 50 in FIG. 1.

The pulse width is determined by using the feedback curve 304 and the linear darkness. The feedback curve represents the current operating condition of the engine, the toner area coverage, the shifting of the different colors, etc. Various pulse widths are imaged and the resulting darkness measured. This function can be measured and modified as often as needed.

A special test image may be used to gather the darkness feedback information or patches of halftone image area contained within the encoded gray pixel halftone of an original document may be used if they are of appropriate size and position to be sensed by toner area measurement sensor 50 in FIG. 1. The upper left quadrant shows a resulting pulse width 306 as a function of the halftone encoding.

The Jones plot is used a follows. The darkness information is plotted on FIG. 4 at point 310. A vertical line 312 is drawn from point 310 to point 314 on the unity quadrant line 302. A horizontal line 316 is drawn to the Feedback curve 304. Because this curve is changing due to the characteristics of the printer, the point 318 will have different scaler pulse width values. A vertical line 320 is drawn to point 322 on the Resultant Pulse Width Function curve 306. A horizontal line 324 is drawn to the Y-axis (encoding values). The encoding value is entered into the gray pixel code LUT 211 by the printer controller 208 in FIG. 3 and thereby affects the imager 206 light pulse characteristics for each gray pixel code. As a result the printer prints a final halftone image of the original document which is based on both a first encoded gray pixel halftone 209 and the characteristics of the printer at the time of the most recent update of the gray pixel code LUT 211.

Although the invention has been described and illustrated with particularity, it is intended to be illustrative of preferred embodiments. It is understood that the disclosure has been made by way of example only. Numerous changes and the combination and arrangements of parts, steps, and features can be made by those skilled in the art without departing from the spirit and scope of the invention, as hereinafter claimed.

What is claimed is:

1. A method of controlling deposition of toner for printing of a final halftoned image by a printer, comprising the steps of:

(a) generating a continuous tone image based on an original document;

(b) generating a first halftoned image by encoding as gray pixel data, the continuous tone image as a plurality of gray pixels, wherein the encoded gray pixel data is in the form of one of a plurality of pixel codes, each of which designate specific combinations of the overall darkness of the pixel and the location of the darkness within the pixel boundary;

(c) producing a feedback signal based on toner application operation of the printer; and (d) generating the final halftoned image based on the encoded gray pixel data and the feedback signal, wherein the feedback signal only effects the generating of the final halftoned image.

2. The method according to claim 1, wherein the continuous tone image is generated by using a tone reproduction curve.

3. The method according to claim 1, wherein the encoded gray pixel data is stored in a memory device.

4. The method according to claim 3, wherein the stored encoded gray pixel data is relayed to a different printer.

5. The method according to claim 4, wherein a network is used to relay the stored encoded gray pixel data.

6. The method according to claim 1, wherein a first apparatus encodes the continuous tone image, and a second apparatus generates the final halftoned image.

7. The method according to claim 1, wherein the printer is a color printer.

8. The method according to claim 7, wherein the feedback signal contains information to adjust for toner shifting of different color.

9. An apparatus for controlling deposition of toner for printing of a final halftoned image by a printer comprising:

means for generating a continuous tone image;

halftoner means for generating pixel data based on the continuous tone image, the encoded gray pixel data being in the form of one of a plurality of pixel codes each of which designate specific combinations of the overall darkness of the pixel and the location of the darkness within the pixel boundary;

a controller monitoring the toner application operation of the printer and generating a feedback signal based on characteristics of the printer; and an imager generating the final halftoned image based on the encoded gray pixel data and the feedback signal, wherein the feedback signal is used only by the imager.

10. The apparatus according to claim 9, wherein the means for generating the continuous tone image is a scanner.

11. The apparatus according to claim 9, wherein the means for generating the continuous tone image is a computer.

12. The apparatus according to claim 9, wherein the continuous tone image is generated by using a tone reproduction curve.

13. The apparatus according to claim 1, wherein the encoded gray pixel data is stored in a memory device.

14. The apparatus according to claim 13, wherein the stored encoded gray pixel data is relayed to a different printer.

15. The apparatus according to claim 14, wherein a network is used to relay the store encoded gray pixel data.

16. The apparatus according to claim 9, wherein the halftoner means and the imager are separate apparatus.

17. The apparatus according to claim 9, wherein the printer is a color printer.

18. The apparatus according to claim 17, wherein the feedback signal contains information to adjust for toner shifting of different color.

* * * * *